US006839992B1

(12) United States Patent
Clark et al.

(10) Patent No.: US 6,839,992 B1
(45) Date of Patent: Jan. 11, 2005

(54) QUILTING FRAME APPARATUS

(76) Inventors: Barbara F. Clark, 2694 Hwy. 180E, Breckenridge, TX (US) 76424; Charles G. Clark, 2694 Hwy. 180E, Breckenridge, TX (US) 76424

( * ) Notice: Subject to any disclaimer, the term of this patent is extended or adjusted under 35 U.S.C. 154(b) by 0 days.

(21) Appl. No.: 10/709,601

(22) Filed: May 17, 2004

(51) Int. Cl.[7] ..... D06C 3/08
(52) U.S. Cl. ..... 38/102.2
(58) Field of Search ..... 38/102.1, 102.2, 38/102.3, 102.4, 102.6, 102.7, 102.9, 102.91; 160/371, 378, 380, 403; 108/6, 7, 139, 150, 160; 248/371, 425, 163.1

(56) References Cited

U.S. PATENT DOCUMENTS 1,093,136 A * 4/1914 Jucker et al. ..... 38/102.2
4,247,998 A * 2/1981 Foss ..... 38/102.2
4,422,251 A * 12/1983 Hedrick ..... 38/102.2
4,726,556 A * 2/1988 Weir ..... 248/454
5,226,250 A * 7/1993 Ulmer et al. ..... 38/102.9
5,870,840 A * 2/1999 Geils et al. ..... 38/102.21
6,212,800 B1 * 4/2001 Bagley ..... 38/102.1

* cited by examiner

*Primary Examiner*—Ismael Izaguirre
(74) *Attorney, Agent, or Firm*—Michael R. Nichols

(57) ABSTRACT

A quilting frame apparatus is disclosed, which provides a user with a more efficient work area than is provided with traditional quilting frames. The quilting frame apparatus comprises concentric rectangular outer and inner frames. The outer frame is constructed from four elongate members attached in a mortise-and-tenon arrangement at each of its four corners and secured by wingnuts. The quilting frame may be adjusted at different angles to suit the user. The apparatus may also be folded for convenient storage.

16 Claims, 5 Drawing Sheets

QUILTING FRAME APPARATUS

TECHNICAL FIELD

The present invention relates generally to equipment used in the production of hand-made quilts. Specifically, the present invention relates to an improved apparatus for holding an item of work during the quilting process.

BACKGROUND ART

The craft of producing hand-made quilts has long been an American tradition. Generally, a quilt is composed of three layers, a top layer, a layer of batting, and a layer of backing. The top layer of a quilt may be a single layer of fabric, but is more often composed of multiple pieces of fabric sewn together end to end to form a single layer. In some quilt designs, small pieces of fabric are sewn together in a mosaic or patchwork pattern, while in others, the top layer is made up of individual squares, with each square containing some sort of design (possibly embroidered or composed of multiple pieces of material of different colors).

Underneath the top layer of the quilt is the batting. Batting is a filling or stuffing material. Modern quilts generally utilize some form of synthetic fiber-fill material (generally in a sheet form) as batting, although other similar materials (including both natural and artificial materials) that provide bulk and insulation to the quilt may be used. Beneath the batting is the backing layer, which is usually a single layer of fabric. The backing and top layers of the quilt are sewn together along their edges to form a seam that encloses the backing.

The process of "quilting" refers to the particular manner in which the three layers are sewn together. In addition to being stitched together with seams around the edges, quilts are stitched together at locations in the middle of the quilt as well. These "interior stitches" extend through all three layers of material and generally form some form of decorative pattern that complements the design of the top layer.

As is also the case with embroidery, is it difficult to produce attractive "interior stitches" without some convenient way to hold the material, since the needle must pass through both sides of the work. In embroidery, it is common to use round or oblong "hoops" to hold and stretch the material being embroidered into a generally planar configuration that is easy to work with. These hoops generally consist of two concentric hoops of some rigid material (such as wood, plastic, or metal), where the material to be embroidered is stretched over the inner hoop, and the outer hoop is placed around the material and inner hoop to hold the material against the inner hoop. Often the outer hoop will have a screw or other adjustment mechanism to allow the inner diameter of the outer hoop to be adjusted to allow the hoop to be tightened around the material and inner hoop.

Traditionally, quilters have employed quilting frames that are a close analogue of the embroidery hoop to position and hold their work. These frames, like embroidery hoops, are generally constructed in some rounded or oblong shape, but in a larger size, so as to accommodate the larger dimensions of typical quilts. In addition, quilting frames are usually constructed so as to be free-standing, to support the large size and weight of typical quilts. The traditional round or oblong quilting frame shape, however, suffers from a number of disadvantages. First, traditional round or oblong frames provide a limited work area in relation to their size. Second, since most quilts are rectangular in shape, the traditional frames do not conform well to the shape of the quilt. As a consequence of these first two disadvantages, a quilter must frequently reposition the quilt within the frame as work progresses. A third disadvantage of the traditional design is that the durability of the traditional frame is limited by the fact that the round or oblong outer hoop must be flexed in order to tighten or loosen the frame; this places limitations on the strength and useful operating life of such a frame. What is needed, then, is a durable quilting frame that provides a larger and more useful work area than is possible with traditional quilting frames.

SUMMARY OF INVENTION

A preferred embodiment of the present invention provides a quilting frame apparatus that provides the user with a more efficient work area than is provided with traditional quilting frames. The quilting frame apparatus comprises concentric rectangular outer and inner frames. The outer frame is constructed from four elongate members attached in a mortise-and-tenon arrangement at each of its four corners and secured by wingnuts. The quilting frame may be adjusted at different angles to suit the user. The apparatus may also be folded for convenient storage.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

Figure 1:
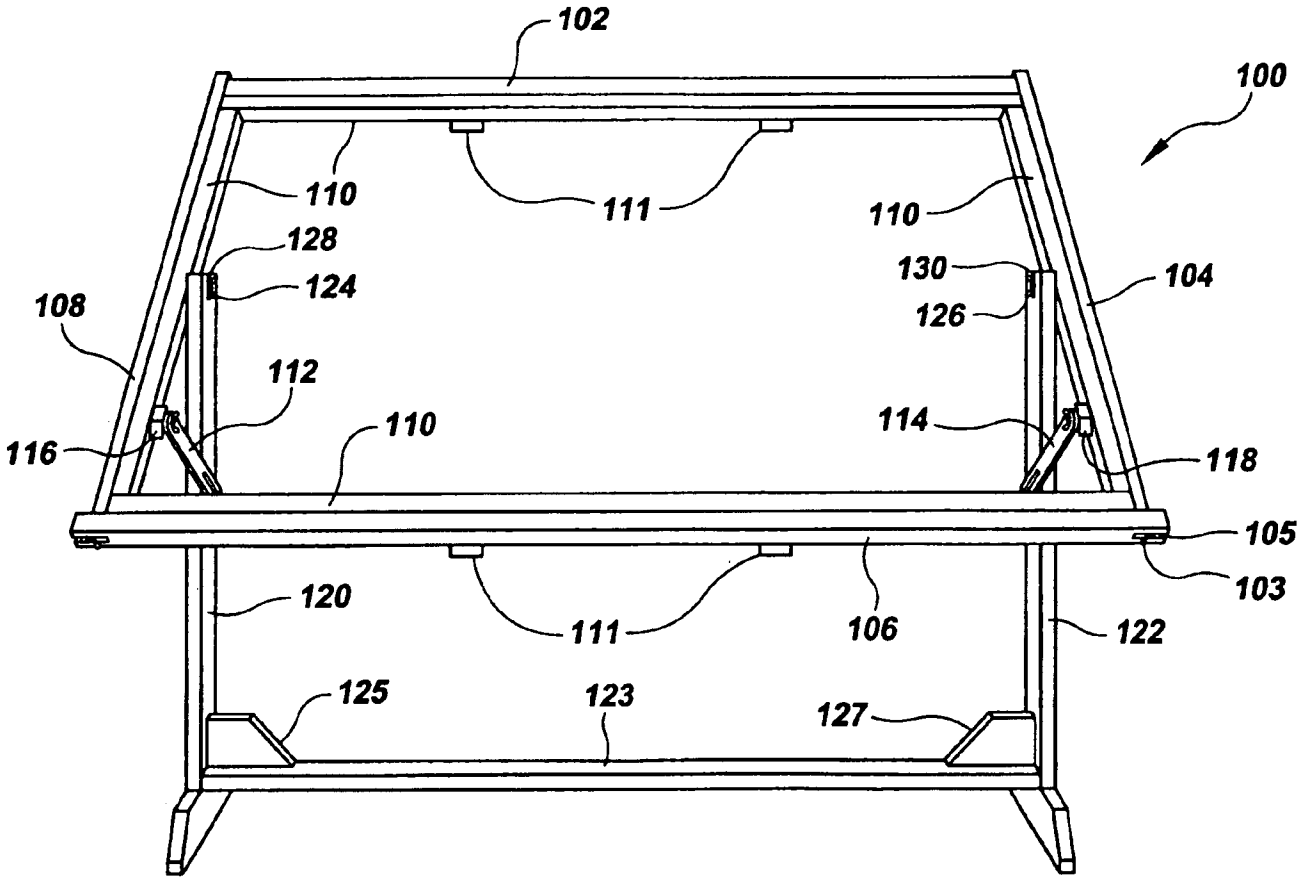
FIG. 1 is a diagram of a quilting franc apparatus in accordance with a preferred embodiment of the present invention.

FIG. 1 is a diagram of a quilting frame apparatus 100 in accordance with a preferred embodiment of the present invention. Quilting frame apparatus 100 provides a large rectangular work area, which allows a quilter to work for longer periods of time without the inconvenience of moving the quilt being worked on. Further, since many quilts are constructed of square or rectangular pieces, the rectangular shape provides a work area that better conforms to such rectangular quilt layouts than with conventional oblong quilting frames/hoops.

Turning now to the details of construction, the rectangular work area is defined by an outer frame, which comprises four removable outer pieces 102, 104, 106, and 108, and an inner frame 110, the four sides of which are permanently connected together to form a rectangle. In a preferred embodiment, inner frame 110 is glued and nailed together from four elongated pieces of wood.

Figure 2:
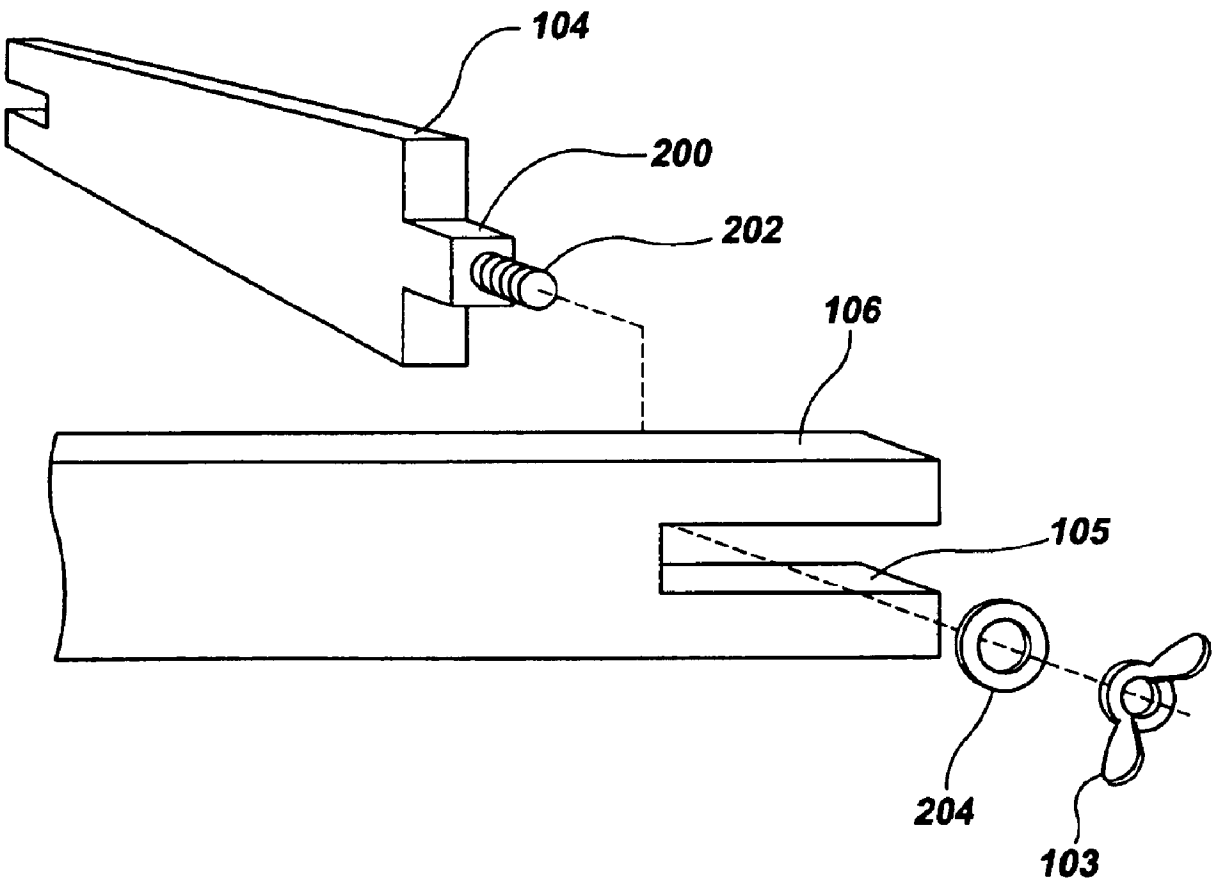
FIG. 2 is a diagram of a mortise-and-tenon joint used in the outer frame of a quilting frame apparatus in accordance with a preferred embodiment of the present invention.
Figure 5:
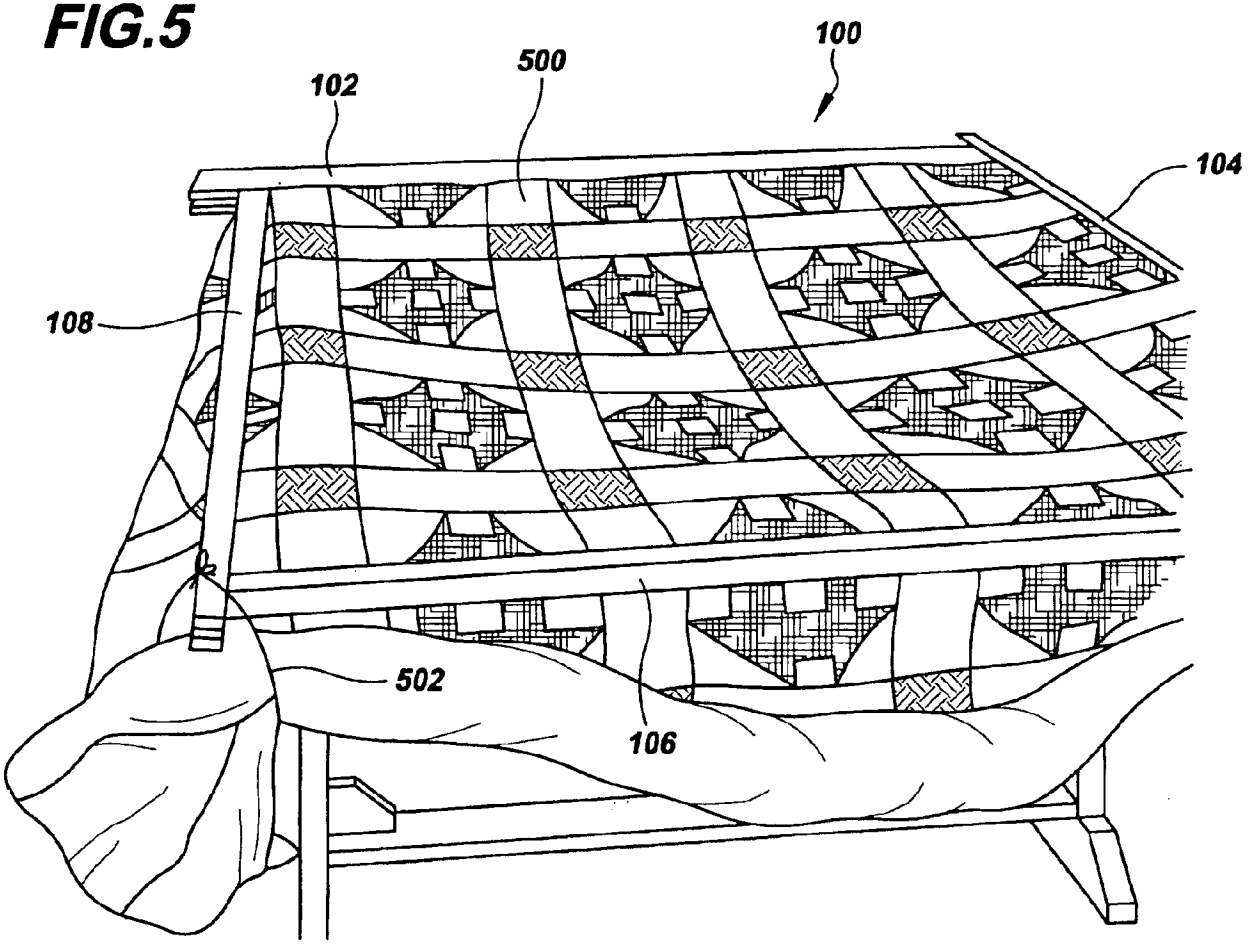
FIG. 5 is a diagram depicting a preferred method of use of a quilting frame apparatus in accordance with a preferred embodiment of the present invention.

Outer pieces 102, 104, 106, and 108 are connected at the corners using bolts and wingnuts in a mortise and tenon arrangement, as depicted in FIG. 2. For example, outer piece 104 is fitted to outer piece 106 at mortise 105 (of outer piece 106) and secured with a bolt and wingnut 103. Wingnut 103 and the other wingnuts connecting outer pieces 102, 104, 106, and 108 serve the dual role of assembling outer pieces 102, 104, 106, and 108 into a rectangular shape as well as allowing a user to adjust the tension with which the work (i.e., the quilt being worked on) is held. When quilting frame apparatus is in use, the work is held between the outer frame (outer pieces 102, 104, 106, and 108) and inner frame 110, as shown in FIG. 5. In a preferred embodiment of the present invention, outer pieces 102 and 106 are approximately 45.5 inches in length, and outer pieces 104 and 108 are approximately 34 inches in length. One of ordinary skill in the art will recognize, however, that embodiments may be constructed in different sizes and with different dimensions, without departing from the scope and spirit of the present invention.

Since each of outer pieces 102, 104, 106, and 108 must be attached individually to form the outer frame of quilting frame apparatus 100, outer-frame supports ill extend outward from inner frame 110 to support outer piece 102 and outer piece 106 temporarily until these pieces can be joined with outer piece 108 and outer piece 104 to complete the outer frame.

Figure 4:
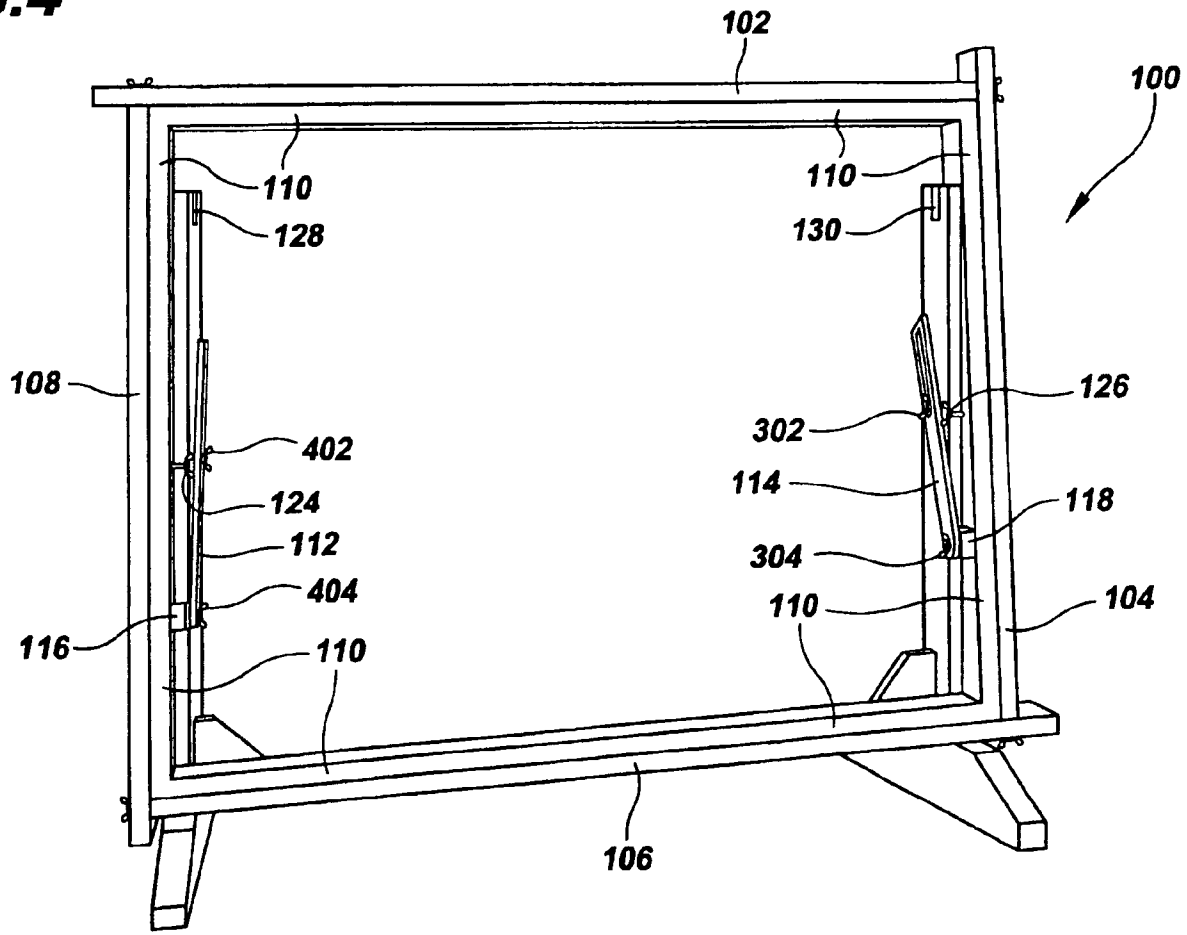
FIG. 4 is a diagram depicting a quilting frame apparatus in a folded position in accordance with a preferred embodiment of the present invention.

Two adjustable rotating arms 112 and 114 connect inner frame 110 to support posts 120 and 122 at spacers 116 and 118, respectively. Rotating arms 112 and 114 allow the user of quilting frame apparatus 100 to adjust the work/viewing angle of the quilt and also allow the user to fold up quilting frame apparatus 100 for storage, as depicted in FIG. 4. Additional support for inner frame 110 is provided at support pins 124 and 126, which rest at the apexes of support forks 128 and 130, which are located at the tops of support posts 120 and 122.

Additional structural stability is provided by cross beam 123, which extends horizontally to connect the bases of support posts 120 and 122. Corner braces 125 and 127 provide a secure and stable connection between cross beam 123 and support posts 120 and 122.

An embodiment of the present invention is preferably constructed from a hardwood, such as ash or oak. One of ordinary skill in the art, however, that embodiments of the present invention may be constructed from other rigid materials, including non-wood materials, without departing from the scope and spirit of the present invention.

FIG. 2 is an exploded-view diagram providing additional detail regarding the mortise and tenon connections that connect outer pieces 102, 104, 106, and 108 to form the outer frame. In FIG. 2, outer piece 104 has a tenon 200 from which a bolt 202 extends outward. To connect outer piece 104 to outer piece 106, tenon 200 is inserted into mortise 105 and secured at bolt 202 with washer 204 and wingnut 103, as shown. Washer 204 should be of a sufficient outer diameter to extend over the edges of mortise 105 so as to securely fasten outer piece 104 to outer piece 106.

Figure 3:
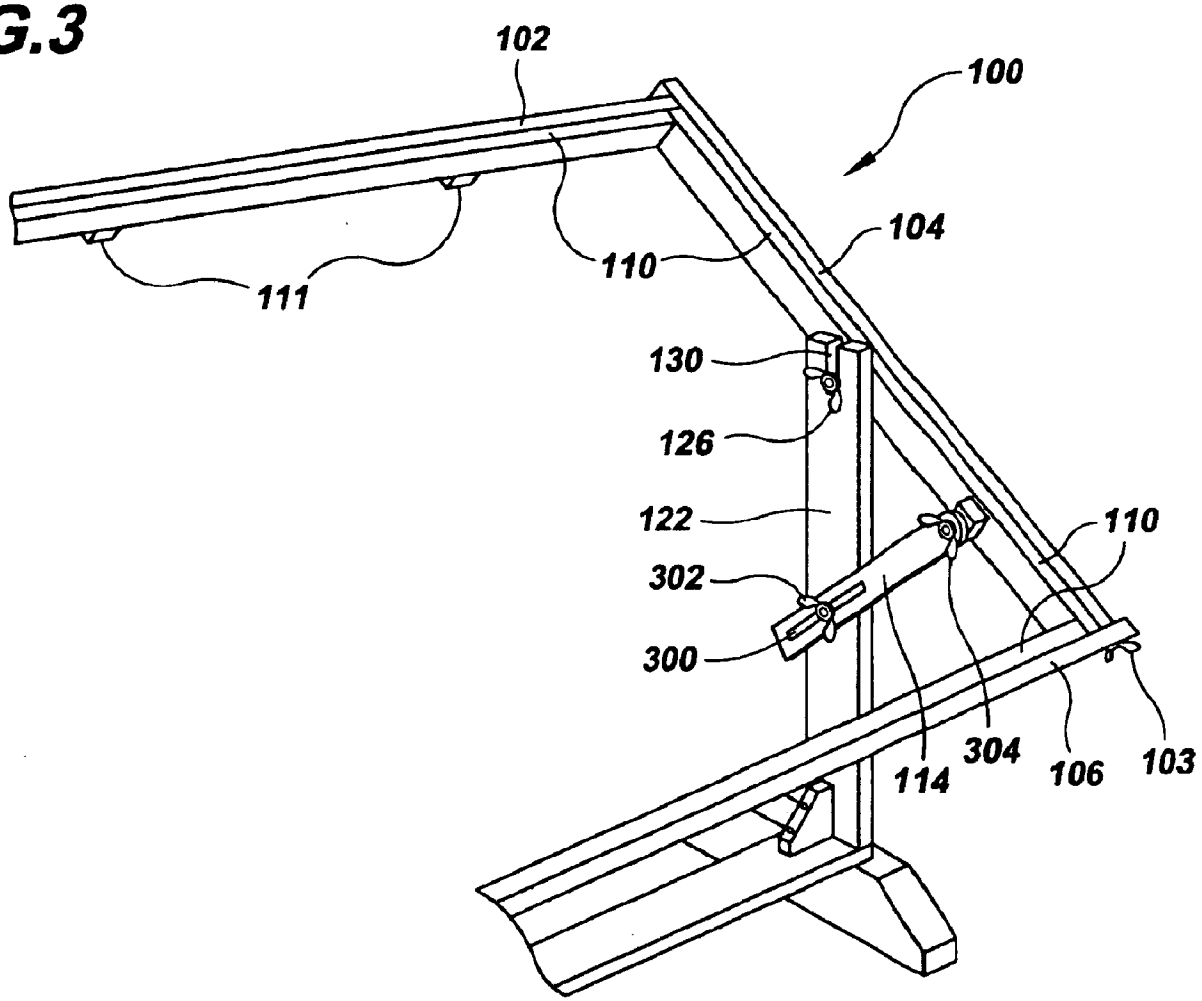
FIG. 3 is a diagram depicting a mechanism used to adjust the viewing angle of a quilting frame apparatus in accordance with a preferred embodiment of the present invention.

FIG. 3 provides additional detail regarding the construction and operation of the mechanism used to adjust the viewing angle of quilting frame apparatus 100. For simplicity, only one side of quilting frame apparatus 100 is depicted; the opposite side operates similarly. Inner frame 110 is supported by support fork 130 of support post 122 at support pin 126. Inner frame 110 (and the outer frame that is attached to it) may pivot about support pin 126. Rotating arm 114 is used to hold inner frame 110 at a constant angle, according to the user's preferences. Rotating arm 114 is connected to inner frame 110 at bolt and wingnut assembly 304, which provides a second pivot point for inner frame 110. Rotating arm is secured to support post 122 at bolt and wingnut assembly 302, which extends through slot 300 in rotating arm 114 and which forms a triangle with support pin 130 and bolt and wingnut assembly 304. The angle of inner frame 110 can be adjusted by positioning rotating arm 114 in different relative positions with respect to bolt and wingnut assembly 302. Tightening bolt and wingnut assembly 302 then causes this angle to be fixed.

FIG. 4 is a diagram depicting quilting frame apparatus 100 having been folded into a compact configuration for storage. Support pins 124 and 126 are lifted out of support forks 128 and 130, and the inner/outer frame assembly (comprising outer pieces 102, 104, 106, and 118 and inner frame 110) is lowered by the rotation of rotating arms 124 and 126 about bolt and wingnut assemblies 402 and 302. The inner/outer frame assembly is further positioned, by way of pivoting at bolt and wingnut assemblies 404 and 304, so that the geometric plane defined by inner frame 110 is approximately parallel to the vertical direction. The inner/outer frame Assembly partially rests upon support posts 128 and 130 at spacers 116 and 118.

FIG. 5 is a diagram depicting quilting frame apparatus 100 as configured for use during the quilting process. A quilt 500 is draped over inner frame 110 (not shown). Outer pieces 102, 104, 106, and 108 are positioned over quilt 500 and connected so as to form an outer frame that holds quilt 500 securely against inner frame 110. Quilt 500 is thus held by quilting frame apparatus 100 in a relatively taught fashion to permit the user of quilting frame apparatus 100 to have a rectangular and approximately planar surface of quilt 500 to work with, while also allowing the user access to the reverse side of quilt 500, as is necessary for hand stitching.

According to a preferred method of use of the present invention, one makes the backing and batting for the quilt extend at least four inches beyond the edges of all four sides of the top layer of the quilt. A three-inch-wide strip of scrap fabric is then basted to all four sides of the top layer. This allows a user of quilting frame apparatus 100 to quilt to the edge of quilt 500. According to this preferred method, one starts quilting in the middle of quilt 500 and quilts outward toward the edges of quilt 500. To keep quilt 500 from touching the floor, the edges of quilt 500 are rolled up toward quilting frame apparatus 100 and tied with a string 502, as shown in FIG. 5.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A quilting frame apparatus comprising:

a polygonal inner frame; and a removable polygonal outer frame configured to fit snugly around the polygonal inner frame, wherein the polygonal outer frame includes a plurality of elongate members, wherein the plurality of elongate members are configured to be connected to one another in an end to end fashion to form the polygonal outer frame, and % herein the plurality of elongate members are connected using mortise-and-tenon joints.

2. The apparatus of claim 1, wherein the polygonal inner frame is rectangular.

3. The apparatus of claim 1, wherein each of the mortise-and-tenon joints is secured with a bolt and nut.

4. The apparatus of claim 1, further comprising:

a support structure, wherein the support structure provides support to the inner frame.

5. The apparatus of claim 4, wherein the support structure is adapted to allow the apparatus to be free-standing.

6. The apparatus of claim 4, wherein the inner frame includes a support pin, wherein the support structure includes a support fork, and wherein the support fork is adapted to support the support pin so as to allow the inner frame to pivot about the support pin.

7. A quilting frame apparatus comprising:

a polygonal inner frame;

a removable polygonal outer frame configured to fit snugly around the polygonal inner frame;

a support structure wherein the support structure provides support to the inner frame, wherein the inner frame includes a support pin, wherein the support structure includes a support fork, and wherein the support fork is adapted to support the support pin so as to allow the inner frame to pivot about the support pin; and a rotatable arm associated with the support structure and the inner frame.

8. The apparatus of claim 7, wherein the rotatable arm is adjustable such that a point of attachment between the rotatable arm and the support structure may be relocated to an alternative position in relation to the rotatable arm.

9. The apparatus of claim 8, wherein the rotatable arm includes a slot, and the rotatable arm is attached to the support structure with a bolt and nut, wherein the bolt extends through the slot.

10. The apparatus of claim 7, wherein the rotatable arm is configured so as to permit the inner frame to be raised so as to remove the support pin from the support fork, then lowered into a space-conserving position.

11. A quilting frame apparatus comprising:

a polygonal inner frame;

a removable polygonal outer frame configured to fit snugly around the polygonal inner frame; and outer frame supports extending from the inner frame, wherein the outer-frame supports are positioned so as to support the outer frame during installation of the outer frame.

12. A method comprising:

laying at least one layer of material over a polygonal frame;

placing a first elongate member against the at least one layer of material such that the at least one layer of material is sandwiched between the first elongate member and a surface of the polygonal frame;

placing a second elongate member against the at least one layer of material such that the at least one layer of material is sandwiched between the second elongate member and a surface of the polygonal frame;

fastening an end of the first elongate member to an end of the second elongate member;

attaching additional elongate members to the first elongate member and second elongate member so as to secure the at least one layer of material to the polygonal frame; and attaching a mortise associated with the first elongate member to a tenon associated with the second elongate member.

13. The method of claim 12, further comprising:

securing the mortise and tenon with a fastener.

14. The method of claim 13, further comprising:

adjusting a tension with which the at least one layer of material is secured to the polygonal frame by adjusting the fastener.

15. The method of claim 12, further comprising:

sewing through the at least one layer of material.

16. A method comprising:

laying at least one layer of material over a polygonal frame;

placing a first elongate member against the at least one layer of material such that the at least one layer of material is sandwiched between the first elongate member and a surface of the polygonal frame;

placing a second elongate member against the at least one layer of material such that the at least one layer of material is sandwiched between the second elongate member and a surface of the polygonal frame;

fastening an end of the first elongate member to an end of the second elongate member;

attaching additional elongate members to the first elongate member and second elongate member so as to secure the at least one layer of material to the polygonal frame; and tying an edge of the at least one layer of material to at least one elongate member so as to prevent the at least one layer of material from coming into contact with a floor.

* * * * *

UNITED STATES PATENT AND TRADEMARK OFFICE

CERTIFICATE OF CORRECTION

PATENT NO. : 6,839,992 B1
DATED : January 11, 2005
INVENTOR(S) : Clark et al.

It is certified that error appears in the above-identified patent and that said Letters Patent is hereby corrected as shown below:

Column 2,
Line 40, “franc” should read -- frame --.

Column 3,
Line 29, “ill” should read -- 111 --.

Column 5,
Line 7, “%herein” should read -- wherein --.

Signed and Sealed this

Eighth Day of March, 2005

JON W. DUDAS
*Director of the United States Patent and Trademark Office*